US008333607B1

(12) United States Patent
Moldoch et al.

(10) Patent No.: US 8,333,607 B1
(45) Date of Patent: Dec. 18, 2012

(54) CONNECTOR WITH PIVOTABLE WINGS, A LOCKING CAM NUT AND A DEFLECTABLE CONTACT RING

(75) Inventors: Michael J. Moldoch, Griswold, CT (US); Adam Murano, Lebanon, CT (US)

(73) Assignee: Ortronics, Inc., New London, CT (US)

( * ) Notice: Subject to any disclaimer, the term of this patent is extended or adjusted under 35 U.S.C. 154(b) by 55 days.

(21) Appl. No.: 13/036,706

(22) Filed: Feb. 28, 2011

(51) Int. Cl.
*H01R 13/62* (2006.01)

(52) U.S. Cl. ..... 439/367

(58) Field of Classification Search ..... 439/367, 439/314, 135, 352, 373, 404, 417
See application file for complete search history.

(56) References Cited

U.S. PATENT DOCUMENTS

| | | | |
|---|---|---|---|
| 4,405,187 | A | 9/1983 | Muller et al. |
| 4,452,502 | A | 6/1984 | Forberg et al. |
| 4,533,201 | A | 8/1985 | Wasserlein, Jr. |
| 5,492,484 | A | 2/1996 | Archer |
| 5,647,760 | A | 7/1997 | Drach et al. |
| 5,752,849 | A | 5/1998 | Orlando |
| 5,820,404 | A | 10/1998 | Chishima et al. |
| 5,931,703 | A | 8/1999 | Aekins |
| 5,934,930 | A | 8/1999 | Camps et al. |
| 5,957,720 | A | 9/1999 | Boudin |
| 6,113,419 | A | 9/2000 | Finley et al. |
| 6,126,476 | A | 10/2000 | Viklund et al. |
| 6,280,231 | B1 | 8/2001 | Nicholls |
| 6,406,323 | B2 | 6/2002 | Chung Long Shan |
| 6,752,647 | B1 | 6/2004 | Lin |
| 6,817,902 | B2 | 11/2004 | Bernardi et al. |
| 6,935,886 | B2 | 8/2005 | Hoch et al. |
| 6,948,971 | B2 | 9/2005 | Bartholoma et al. |
| 7,214,094 | B2 | 5/2007 | Kaminski et al. |
| 7,413,464 | B1 | 8/2008 | Chen |
| 7,628,657 | B2 | 12/2009 | Martich |
| 7,758,383 | B1 | 7/2010 | Chantrell et al. |

(Continued)

FOREIGN PATENT DOCUMENTS

EP 1973198 9/2008

(Continued)

OTHER PUBLICATIONS

PCT International Search Report and Written Opinion for WO 2010/083364 dated Mar. 22, 2010.

(Continued)

*Primary Examiner* — Chandrika Prasad
(74) *Attorney, Agent, or Firm* — McCarter & English, LLP

(57) ABSTRACT

An integrated insulation displacement terminal includes an IDC assembly with a pair of pivotably mounted wings and a lacing cap assembly with a lacing cap, locking cam nut and deflectable contact ring. The IDC assembly has two rows of IDC terminals mounted on one side and the lacing cap assembly has a lacing cap with two corresponding rows of receiving holes. Each wing pivoted to the IDC base assembly has two pressing portions corresponding to the two rows of IDC terminals so when the wings are rotated to press the lacing cap such that each of the IDC terminals is inserted into one of the receiving holes and each wire is introduced in the corresponding IDC terminal. Each wing has an axial cable guide engaged by the cam nut when the assembly is locked by rotating the cam nut to secure the two assemblies in place and ground the cable.

13 Claims, 3 Drawing Sheets

U.S. PATENT DOCUMENTS

| | | | | |
|---|---|---|---|---|
| 7,857,663 | B2 | 12/2010 | Chantrell et al. | |
| 8,007,307 | B2 * | 8/2011 | Wang | 439/367 |
| 2005/0277335 | A1 | 12/2005 | Gordon et al. | |
| 2006/0246784 | A1 | 11/2006 | Aekins et al. | |
| 2007/0287332 | A1 | 12/2007 | Gordon et al. | |

FOREIGN PATENT DOCUMENTS

| | | |
|---|---|---|
| EP | 2209163 | 7/2010 |
| FR | 2829623 | 3/2003 |
| WO | WO 2008/081087 | 7/2008 |
| WO | WO 2010/083364 | 7/2010 |

OTHER PUBLICATIONS

Extended European Search Report for European Patent Application No. 09251743.2 (EP 2209163 A1) dated Apr. 1, 2010.

* cited by examiner

CONNECTOR WITH PIVOTABLE WINGS, A LOCKING CAM NUT AND A DEFLECTABLE CONTACT RING

BACKGROUND

The present disclosure relates generally to a connector for a foil-shielded twisted pair (FTP) cable, and more particularly to an improved connector including a jack and insulation displacement contact (IDC) assembly with a pair of pushing wings and a lacing cap and twist nut assembly that securely locks the connector and grounds the cable at the same time.

Twisted pair cabling is a form of wiring in which two conductors (wires/cables) are wound together for the purposes of canceling out electromagnetic interference (EMI), electromagnetic radiation from unshielded twisted pair (UTP) wires/cables, crosstalk between neighboring pairs of cable/wire, or radiofrequency interference (RFI). Twisting wires/cables decreases interference because the loop area between the wires is reduced. In balanced pair operation, two wires/cables typically carry equal and opposite signals which are combined by addition at the destination. The common-mode noise from the two wires/cables helps to cancel each other because the two wires have similar amounts of EMI that are 180 degrees out of phase.

In order to reduce interference further and other sources of signal deterioration, electrical wires/cables often further include an insulating jacket surrounding each individual wire, a metal foil or braided sheath surrounding twisted wire/cable pairs and a drain wire. Twisted pair wires/cables are often shielded in attempt to prevent electromagnetic interference, but, because the shielding is made of metal, shielding may also serve as a ground. However, a shielded or screened twisted pair wire/cable usually has a special grounding wire added called a drain wire. A drain wire directs extraneous signals to the ground. Shielding can be applied to individual wire/cable pairs, or to a collection of pairs. When shielding is applied to the collection of all pairs of wires/cables present, the shielding is referred to as screening. Shielding must usually be grounded for the shielding to function properly. Cables which include at least one twisted wire/cable pair (in which the wires/cables may be individually insulated), a drain wire, a metal foil or sheath surrounding the twisted pair(s) and drain wire, and an insulating jacket surrounding the wires/cables and the metal foil or sheath are commonly referred to as foil-shielded twisted pair (FTP) cables.

An FTP cable may be terminated by a connector assembly, such as a jack, that is adapted to operatively engage a mating connector, such as a plug. A jack typically includes a housing, sometimes made from several individual parts, that is manufactured from non-conductive material(s). A jack assembly may include a metal wrap to provide similar interference prevention as the metal foil or sheath in an FTP cable. Stated differently, a metal wrap in a jack housing, or other similarly functioning mechanism, may serve as a continuation of the foil wrap or shielding of an FTP cable so that continuity of shielding is provided to and through the connection into the jack housing. In such shielded jacks, the drain wire of an FTP cable may be secured to the metal wrap. A mating shield plug may be engaged within a shielded jack, and the metal shield of the jack may contact the metal wrap of the jack, thereby providing electrical continuity.

An end user of a connector assembly (also known as a jack) is the installer. An end user typically connects an FTP cable to a corresponding jack manually—i.e., by physically exposing the wire/cable of the twisted pair(s), exposing the terminals located inside the jack housing if they are not already exposed, connecting the wires/cables to the terminals, and, finally, assembling the jack into its final form. The final form of a connector assembly commonly includes a covering or other protecting mechanism over the wire-terminal connections.

PCT Publication WO 2008/081087 discloses a socket to be mounted on a multi-conductor cable and includes a removable comb defining a central channel, a connection terminal block, and a locking screw and nut assembly. Here, the screw is fixedly mounted on the removable comb for axial translation and rotation relative to the axis (X) of the socket. The terminal block includes two columns of posts that prevent the rotation of the comb. The screw has two helical slopes capable of engaging corresponding helical notches in the columns. As the screw is rotated, the helical slopes and helical notches interact and a torque is created. This torque causes translation between the screw and the terminal block, ultimately resulting in a secure connection between the screw, comb and terminal block. The contents of the PCT application WO 2008/081087 is hereby incorporated herein in its entirety.

U.S. Pat. No. 7,758,383 recently issued to the inventors herein discloses FTP connector assemblies including a deflectable contact and a cam nut. The cam nut engages a cam member that passes through and couples the various housing elements together and compresses the deflectable contact to engage with a drain wire and/or shielding of an FTP cable. The contents of our earlier patent is incorporated herein in its entirety.

U.S. Pat. No. 7,413,464 to Chen discloses a locking socket with two pivotable pressing elements to push a terminal pusher to engage each wire in the cable into a corresponding IDC. A cable tie or similar tying element is then tied around the closed pressing elements and the cable to prevent opening of the pressing elements and maintain the engagement of the terminal pusher in place. The contents of Chen U.S. Pat. No. 7,413,464 is hereby incorporated herein in its entirety.

Another U.S. patent disclosing a terminal connector with pivoting wings is U.S. Pat. No. 5,957,720 to Boudin, the contents of which are incorporated herein by reference in its entirety. The Boudin patent discloses a connector with two jaws to press the wires into the IDC terminals, so as to accomplish the electrical connection. The jaws are not locked as in the Chen Patent and the stranded wires may stripped off from the IDC terminals once the stranded wires are dragged. If the cable with stranded wires is vertical to the socket base, this increases the space needed for the socket base, making this configuration not suitable for use in a server host that occupies a small space.

It is important for an end user to securely connect the FTP wire/cable to the jack housing because a secure connection can prevent the FTP cable from pulling away from the housing and therefore cause the twisted pair wires from disconnecting or disengaging from the terminals located inside the jack housing. As discussed above, to ensure proper functionality it is important that an end user securely engages the subcomponents of a jack to one another, provides continuity of shielding to and through the connection into the jack housing, and provides a secure connection between the terminals of the jack and the individual FTP wires.

Notwithstanding these improvements in a variety of FTP connectors, there remains a need to provide a secure way to provide a connector that is easy to assemble and securely locks the components and grounds the cable in one easy and secure movement.

SUMMARY

Generally speaking, in accordance with the invention, a connector with integrated insulation displacement terminals (IDC terminals) including an IDC assembly including a base with a pair of wings (or pressing elements) pivotably mounted on opposite sides of the base and a lacing cap assembly with a lacing cap (or terminal pusher), a deflectable contact and cam nut to secure the closed wings in place and ground the cable is provided. The IDC assembly has a terminal base with two rows of IDC terminals mounted on one end. The wings pivot about the opposite end. The lacing cap assembly has two corresponding rows of receiving holes for holding a plurality of signal wires to be engaged by the respective IDC's. Each wing pivoted to the base has two pressing portions corresponding to the two rows of IDC terminals so that when the wings are pivoted closed about the cable, the pressing portions press the lacing cap such that the IDC assembly and lacing cap assembly are securely locked in place. This insures that each of the IDC terminals is inserted into one of the receiving holes and each of wires is introduced in the corresponding IDC terminal.

Each wing on the IDC assembly has a key hole that engages a protruding key portion formed in the respective sides of the base. Each wing also includes an axial cable guide engaged by the cam nut when the assembly is locked by rotating the cam nut. A deflectable contact ring in the lacing cap assembly is positioned between the lacing cap and cam nut when the cam nut is rotated into locking engagement with the closed wings on the connection base and the deflectable contact is compressed and deflected into engagement with an installed cable. This grounds the cable as the two assemblies are securely locked together.

Accordingly, it is an object of the invention to provide an improved FTP connector.

Another object of the invention is to provide an improved locking FTP connector.

A further object of the invention is to provide an improved FTP connector that locks the wires in the IDC's and grounds the cable when locked.

Yet another object of the invention is to provide an improved FTP connector that provides 360 coverage and shielding for the cable.

Yet a further object of the invention is to provide an FTP connector with rotating wings pivotably mounted on the connector base with key hole opening to engage keys projecting from the base.

The invention accordingly comprises a product possessing the features, properties, and the relation of components and the several steps and the relation of one or more of each steps with respect to each of the others which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION

Figure 1:
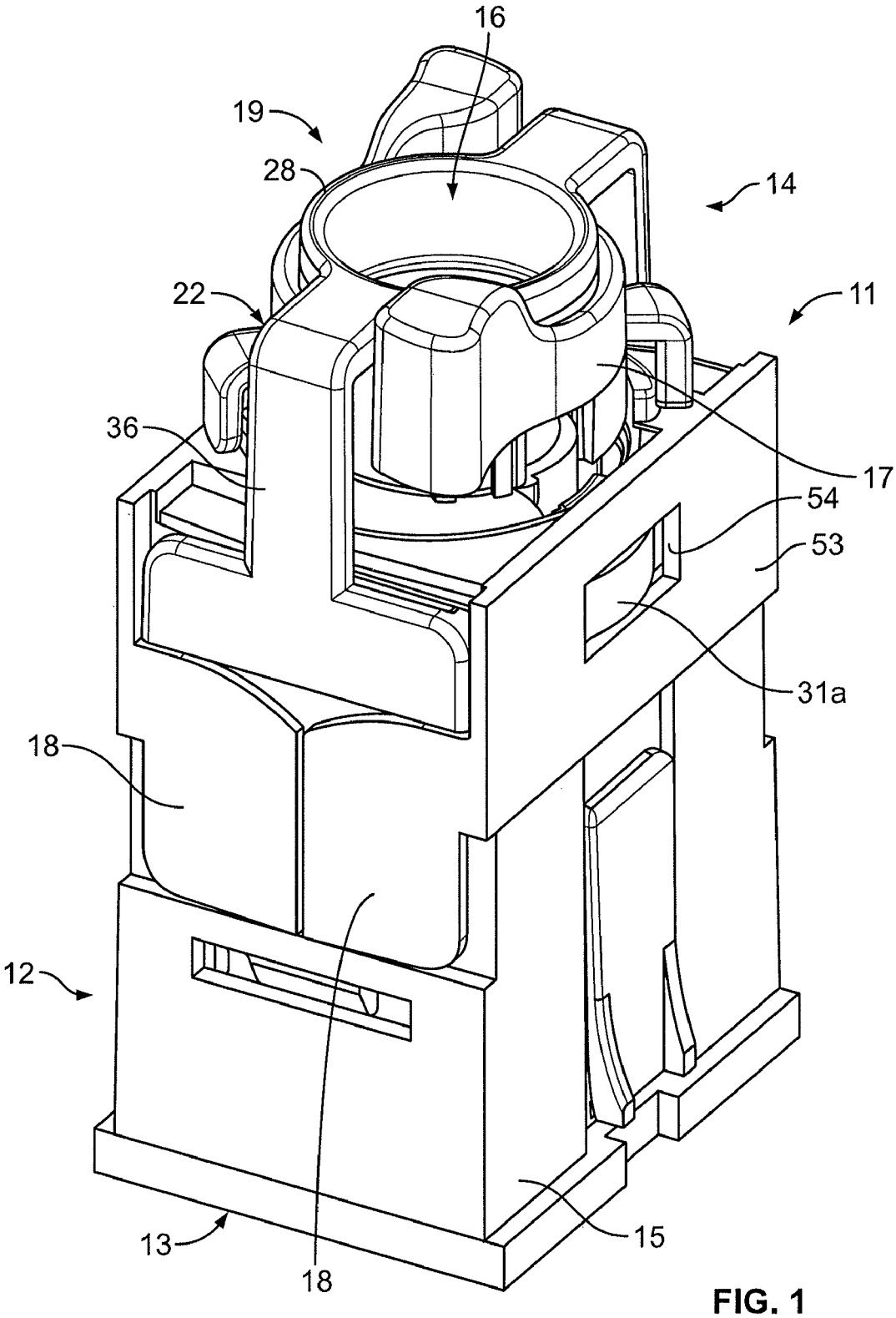
FIG. 1 is a rear perspective view of an fully assembled improved FTP connector including an IDC assembly and lacing cap assembly constructed and arranged in accordance with the invention.

FIG. 1 is a rear perspective view of an improved FTP connector 11 constructed and arranged in accordance with the invention. FTP connector 11 includes an IDC assembly 12 with a terminal base 15 having a standard plug/jack opening on an exposed bottom side 13 and a upper surface 19 with a lacing cap assembly 14 connected thereto. Lacing cap assembly 14 includes an upper surface 19 with a central axial cable opening 16 and a rotatably mounted cam nut 17 for securing lacing cap assembly 14 to IDC assembly 12.

Figure 2:
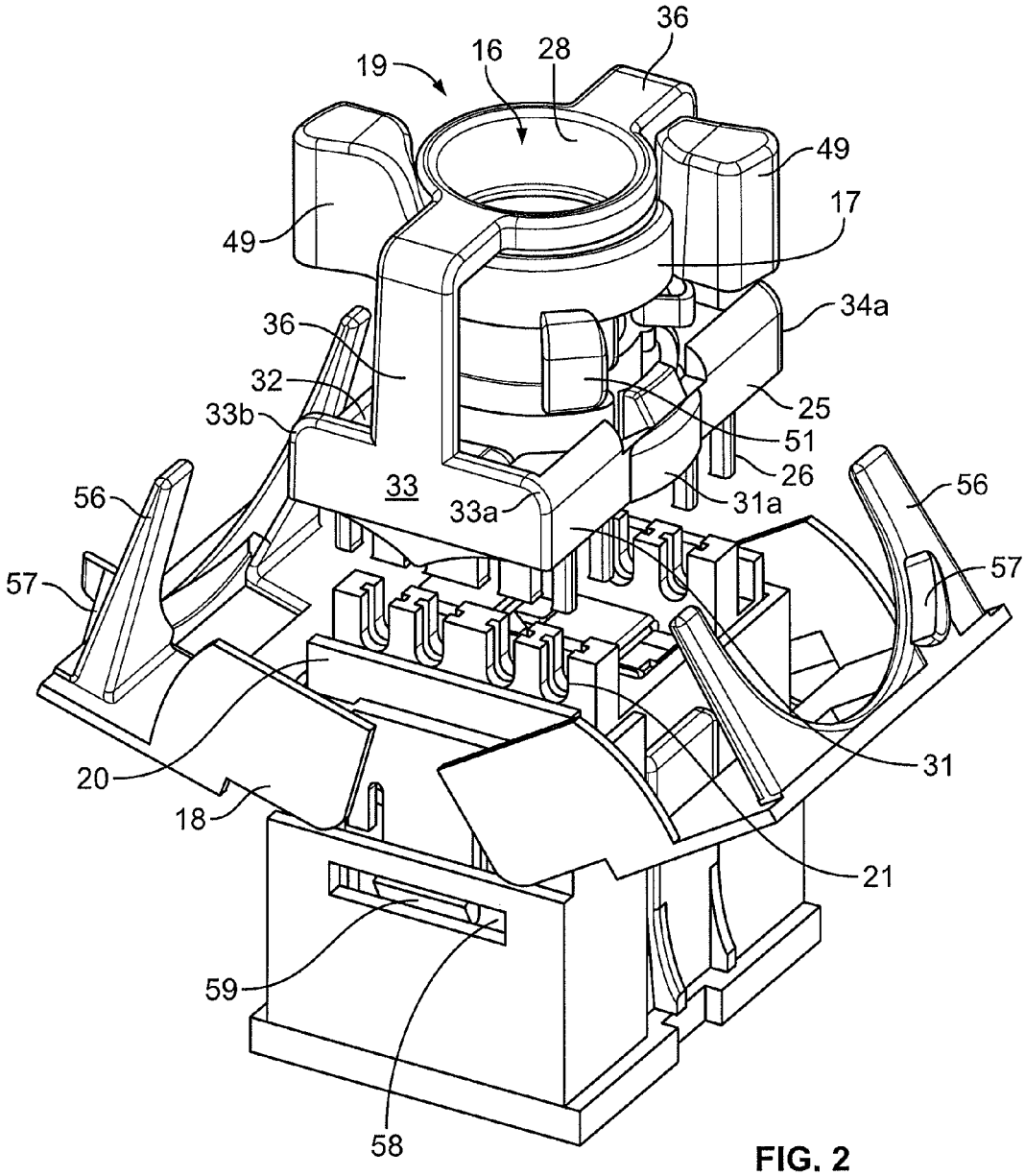
FIG. 2 is a partially exploded perspective view of the connector of FIG. 1 showing pivotably mounted wings in an open position showing the IDC's in the IDC assembly and the assembled lacing cap assembly showing the wire slots.

As shown in the partially exploded view of FIG. 2 of the rear position of connector 11, IDC assembly 12 includes two pivotable pusher wings 18 pivotably mounted to opposite sides of terminal base 15. Terminal base 15 includes an upper surface 20 with two rows of IDC's 21 extending axially.

Figure 3:
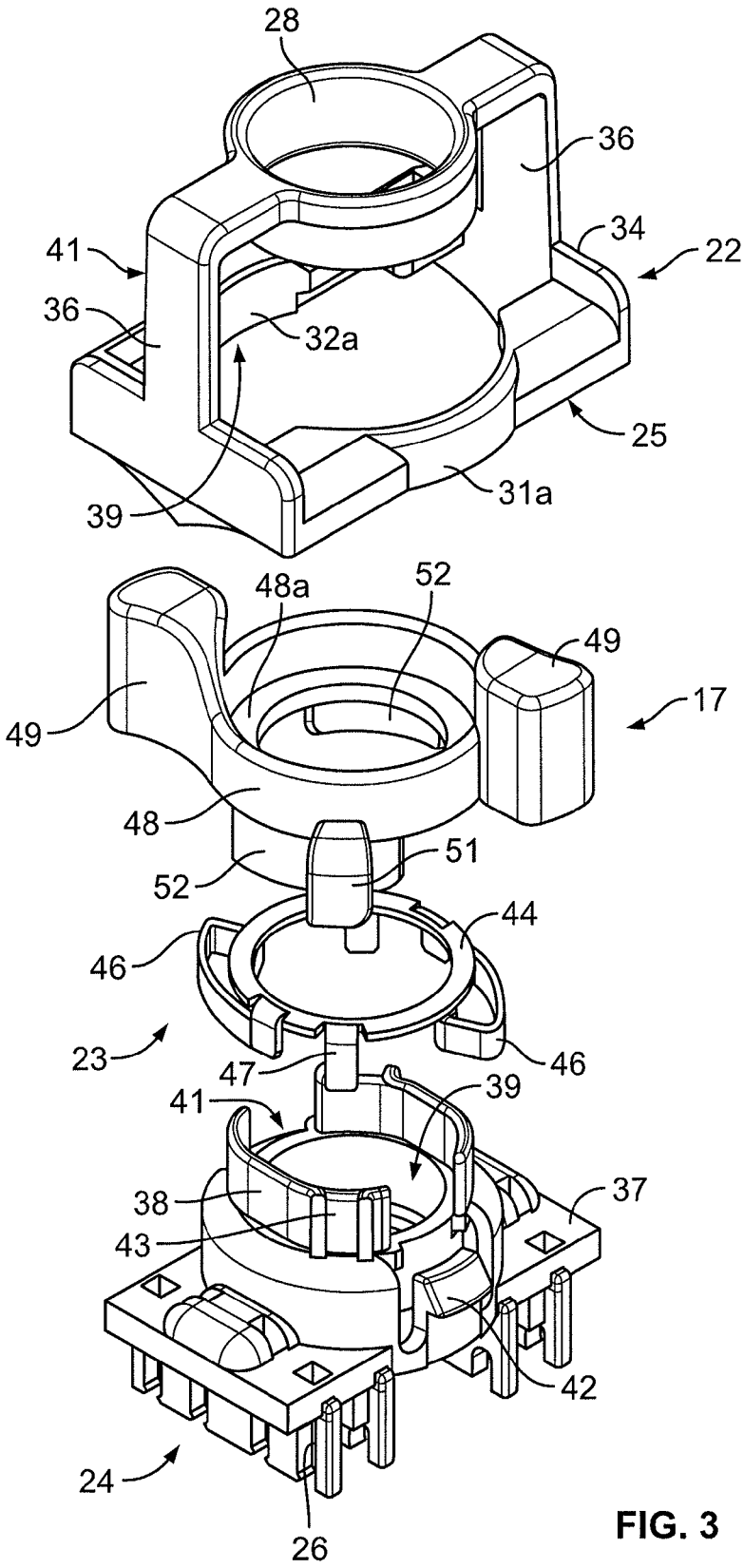
FIG. 3 is an exploded perspective view of the lacing cap assembly showing the lacing cap, deflectable contact ring, cam nut and lacing cap frame.

The components of lacing cap assembly 14 are shown in an exploded view in FIG. 3. Lacing cap assembly 14 includes a lacing cap frame 22, cam nut 17, a deflectable contact ring 23 and a lacing cap 24 with lacing cap base 37 with a lower surface having two rows of wire slots 26. Each of cam nut 17, deflectable contact ring 23 and lacing cap 24 has a central opening to receive a cable with wires to be inserted into wire slots 26 and connected to IDC's 21.

Lacing cap 24 includes a substantially rectangular lacing cap base 37. Rows of wire slots 26 on lower surface of lacing cap base 37 are arranged to cooperate with IDC's 21 on upper surface 20 of terminal base 15. Lacing cap frame 22 includes an upper cylindrical collar 28 with axial opening 16 and a rectangular cap frame base 25 having a front wall 31 and an opposed rear wall 32, a left side wall 33 and a right side wall 34 connecting front wall 31 and rear wall 32. Lacing cap upper collar 28 is connected to lacing cap side walls 33 and 34 by a pair of side supports 36.

Front wall 31 of lacing cap frame 22 includes a curved central outwardly protruding region 31*a*. Rear wall 32 includes a similar central protruding curved section 32*a*. The vertical edge of left side wall 33 includes an upper front curved caming surface 33*a* and a rear caming surface 33*b*. Right side wall 34 has a corresponding curved front earning surface 34*a* and a rear earning surface (not shown).

Lacing cap frame 22 extending axially upward from lacing cap base 25 has a front opening 39 and opposed rear opening 41 parallel to the front and rear sides of lacing cap base 25 as shown in FIG. 3. Lacing cap base 37 includes a pair of deflectable latches 42 extending upwardly along the front and rear sides thereof for engaging the inside of curved sections 31*a* and 32*a* of lacing cap frame 22 when the components in lacing cap assembly 14 are assembled as shown in FIG. 2. Lacing cap lower collar 38 includes axially extending grooves 43 for engaging deflectable contact ring 23 as will be described below.

Deflectable contact ring 23 includes a conductive ring 44 with a central opening and two opposed deflectable arms 46 extending towards lacing cap collar 28. Ring 44 also includes at least two opposed downwardly facing latching fingers 47 corresponding to grooves 43 on lacing cap collar 38. Arms 46 and fingers 47 are positioned on ring 44 so that when assembled as shown in FIG. 2, arms 46 will extend into opening 39 and 41 in the front and rear of lacing cap collar 28, 38. This allows deflecting arms 46 of deflectable contact ring 23 to be deflected and engage FTP cable installed in connector 11 when cam nut 17 is secured and thereby ground the cable.

Cam nut 17 includes a cylindrical cam ring 48 with an inwardly facing flange 48*a* and two opposed and outwardly extending cam knobs 49 that extend over front wall 31 and rear wall 32 of cap base 25. Flange 48*a* is dimensioned to fit securely around lacing cap collar 28. Ring 48 also includes two opposed cam locking tabs 51 for engaging and locking wings 18 on IDC assembly 12 in place. Ring 48 also includes two opposed contact deflectors 52 extending axially from cam nut cylindrical ring 48. Cam locking tabs 51 and cam deflectors 52 are radially off-set from cam knobs 49 on cam ring 48.

Lacing cap assembly 14 is assembled as shown in FIG. 2 by placing cam knobs 49 of cam nut 17 into the front and rear openings of lacing cap frame 22. Deflectable contact ring 23 is positioned about lacing cap collar 38 with fingers 47 in grooves 43. At this time assembled lacing cap 24 and deflectable contact ring 23 are inserted into the central opening of cam nut 17. Once lacing cap 24 is inserted into lacing cap frame 22, deflectable latches 42 engage the upper surfaces of front wall 31 and rear wall 32 of cap frame 22. This locks the components of lacing cap assembly 14 in place and ready to receive a cable through opening 16.

Referring now to FIG. 2, pivotable wings 18 each include a front wall 53 having an opening 54 for engaging protruding portions 31*a* and 32*a* of front wall 31 and rear wall 32 of cap frame 22 when wings 18 are pivoted and closed about an installed cable. Wings 18 also include two pressing portions 56 extending at right angles from front wall 53 forming a circular opening about the cable. The lower surface of each pressing portion 56 functions as a caming surface to press against curved edges 33*a* and 33*b* of left side wall 33 and surfaces 34*a* and 34*b* of right side wall 34 of cap frame 22. This caming action presses lacing cap 24 towards terminal base 15 so that the wires in wire slots 26 are engaged by IDC 21 on terminal base 15 in the usual fashion. Each wing 18 also includes at least one axial cable guide 57 dimensioned to be engaged by cam nut locking tabs 51. When cam nut 17 is rotated clockwise, locking tabs 51 are covering axial cable guides 57 on wings 18 thereby preventing wings 18 from pivoting open.

As wings 18 are pivoted closed and lacing cap 24 is pushed fully towards terminal base 15, openings 54 in front wall 53 of wings 18 engage curved section 31*a* of front wall 31 and section 32*a* of rear wall 32 of cap frame 22. Once wings 18 are fully closed, cam nut 17 may be rotated clockwise so that locking tabs 51 engage axial cable guides 57. At the same time deflectors 52 engage deflectable arms 46 on deflectable contact ring 23 and are compressed against the installed cable. This locking of wings 18 and cam nut 17 securely locks IDC assembly 12 and lacing cap assembly 14 in terminal 11 and grounds the cable in one simple and secure operation.

In the illustrated embodiment terminal base 15 is composed of separate elements as described in U.S. Pat. No. 7,758,383. This may include a separate jack housing base 12 having latch openings 58 and a wing frame 59 with deflectable latches for securing pivotable wings 18 to terminal base 15. IDC's 21 may also be mounted on a separate board that is fitted into terminal base 15 and secured by deflectable latches as is discussed in our earlier patent.

By providing an FTP terminal with an IDC assembly with pivotable locking wings and a lacing cap assembly with a locking cam nut and deflectable contact ring several advantages are obtained. The pivotable wings provide secure engagement between the two assemblies that are locked together by operation of the wings and cam nut. The pivotable wings provide the pressing force to insure electrical contact between the IDC's and wires in the cable. The rotation and locking action of the locking tabs of the cam nut also provides force to deflect the deflectable contact ring to engage the cable shielding and provide a ground as the two assemblies are securely locked together.

While the invention has been described with reference to certain preferred embodiments, numerous changes, alterations and modifications to the described embodiments are possible without departing from the spirit and scope of the invention as defined in the appended claims, and equivalents thereof.

It will thus be seen that the objects set forth above, among those made apparent from the preceding description, are efficiently attained and, since certain changes may be made in the above method product without departing from the spirit and scope of the invention, it is intended that all matter contained in the above description and shown in the accompanying drawing(s) shall be interpreted as illustrative and not in a limiting sense.

The present invention may be embodied in other specific forms without departing from the spirit or essential attributes of the invention.

What is claimed is:

1. A connector for a foil-shielded twisted pair cable including a plurality of insulation displacement contacts, comprising:

(a) an IDC base assembly including:

a terminal jack base with a plug opening at a first end and a plurality of insulation displacement contacts at an opposed second end; and a pair of pivotable wings including two pressing regions and at least one axial cable guide, the wings mounted to the terminal base and pivotable about the second end of the terminal jack base and IDC's; and (b) a lacing cap assembly having a lacing cap frame with a cylindrical central opening;

a lacing cap including a plurality of wire slots corresponding to the insulation displacement contacts at a first end of the lacing cap frame and a cylindrical lacing cap collar at the other end of the lacing cap;

a cam nut having at least one locking tab mounted for rotation about the cylindrical lacing cap collar; and a deflectable contact ring mounted about the cylindrical cap collar between the collar and the cam nut;

wherein when the wings pivotably mounted on the terminal base are pivoted closed about an installed cable, the pressing regions axially displace the lacing cap towards the IDC's for engaging the wires in the lacing cap slots with the IDC's and the cam locking tabs secures the pivoted wing closed to lock the lacing cap assembly to the IDC assembly and deflect the deflectable contact ring to ground the cable.

2. The connector of claim 1, wherein the lacing cap frame has a substantially rectangular base with a front wall and opposed rear wall and two opposite side walls connecting the front and rear walls and two side supports extending axially from the side walls with a cylindrical collar having a central opening supported between the side supports and the cam nut is positioned within the lacing cap frame.

3. The connector of claim 2, wherein the cam nut includes a cam ring mounted for rotation about the cylindrical lacing cap collar.

4. The connector of claim 1, wherein the lacing cap collar includes at least one open region for receiving a portion of the deflectable contact ring for contacting a cable passed through the collar.

5. The connector of claim 1, wherein the deflectable contact ring includes at least one contact arm for contacting an installed cable and at least one positioning finger and the lacing cap collar includes at least one opening for allowing the at least one contact arm of the deflectable contact to pass there through to contact an installed cable and has at least one groove for receiving the at least one positioning finger of the deflectable contact.

6. The connector of claim 2, wherein the lacing cap includes a deflectable latch about the lacing cap collar along the front and rear sides for engaging the front and rear walls of the lacing cap frame and securing the deflectable contact ring and cam nut in the lacing cap assembly.

7. The connector of claim 2, wherein the edges of the front and rear side walls of the lacing cap frame include curved caming surfaces and the wings on the terminal base assembly are pivotably mounted to the terminal base assembly corresponding to the sides of the lacing cap frame so that when the wire slots of the lacing cap assembly are placed into engagement with the IDC's on the terminal base assembly, the lower surface of each pressing portion on the wings pushes the lacing cap assembly axially into engagement with the terminal base assembly.

8. The connector of claim 7, wherein the front and rear walls of the lacing cap frame include a protruding region and each wing includes an opening corresponding to the protruding regions so that when the wings are pivoted about the lacing cap frame, the protruding regions are engaged by the openings to inhibit axial movement of the lacing cap assembly away from the IDC assembly.

9. The connector of claim 2, wherein the cam ring includes at least one deflector extending towards the deflectable contact ring to compress a portion of the deflectable contact ring against the cable when the cam nut is rotated.

10. The connector of claim 9, wherein both wings include one axial cable guide and the cam ring includes two locking tabs so that the cam locking tabs on the cam nut engage the axial guide members and secure the wings in a closed position and deflect the deflectable arms of the deflectable contact.

11. The connector of claim 2, wherein the deflectable contact ring includes two deflectable arms and the cam ring includes two deflectors extending axially towards the deflectable contact so that the arms are compressed against the cable when the cam nut is rotated.

12. A connector for a foil-shielded twisted pair cable including a plurality of insulation displacement contacts, comprising:

(a) an IDC base assembly including:

a terminal jack base with a plug opening at a first end and a plurality of insulation displacement contacts at an opposed second end; and a pair of pivotable wings including two pressing regions and at least one axial cable guide, the wings mounted to the terminal base assembly and pivotable about the second end of the terminal base and IDC's; and (b) a lacing cap assembly having a lacing cap frame with a cylindrical central opening;

the lacing cap frame having a substantially rectangular base with a front wall and opposed rear wall and two opposite side walls connecting the front and rear wall and two side supports extending axially from the side walls with a cylindrical collar supported between the side supports;

a lacing cap including a plurality of wire slots corresponding to the insulation displacement contacts mounted on one end and an axially extending cylindrical lacing cap collar on the other end of the lacing cap;

a cam nut having two cam locking tabs mounted for rotation about the cylindrical lacing cap collar;

a deflectable contact ring having two deflectable arms and two axially extending positioning fingers mounted about the cylindrical opening in the lacing cap collar; and the lacing cap collar having two slots for receiving the positioning fingers and two openings to allow the deflectable arm to pass through;

wherein when the wings are pivotably mounted on the terminal base are pivoted about an installed cable, the pressing regions axially displace the lacing cap towards the IDC's for engaging the wires in the lacing cap slots with the IDC's and lock the lacing cap assembly to the IDC assembly and deflect the deflectable arms of the deflectable contact ring.

13. The connector of claim 12, wherein the deflectable contact ring includes two axial positioning fingers and the lacing cap collar includes two external positioning grooves for receiving the positioning fingers to prevent rotation of the contact ring relative to the lacing cap collar.

* * * * *